United States Patent [19]

Pamper

[11] Patent Number: 4,921,020

[45] Date of Patent: May 1, 1990

[54] APPARATUS FOR FILLING AND REFILLING OF CONTAINERS WITH FLOWABLE MATERIAL AND PRESSURIZED PROPELLANT

[75] Inventor: Viktor Pamper, Budapest, Hungary

[73] Assignee: Duna Elelmiszer Es Vegyiaru Kereskedelmi Vallalat, Hungary

[21] Appl. No.: 115,627

[22] Filed: Oct. 29, 1987

Related U.S. Application Data

[63] Continuation of Ser. No. 688,909, Jan. 4, 1985, abandoned.

[30] Foreign Application Priority Data

Jan. 6, 1984 [HU] Hungary ..... 42/84

[51] Int. Cl.[5] ..... B65B 31/10; B65B 3/04

[52] U.S. Cl. ..... 141/20; 141/3; 141/37; 141/105

[58] Field of Search ..... 141/18–21, 141/29, 37, 46, 63, 64, 105, 3, 100

[56] References Cited

U.S. PATENT DOCUMENTS

| | | | |
|---|---|---|---|
| 2,518,064 | 8/1950 | Rapisarda | 141/3 X |
| 2,613,023 | 10/1952 | Reich | 141/3 X |
| 3,211,191 | 10/1965 | Honisch | 141/20 |
| 3,995,666 | 12/1976 | Michaels | 141/20 |
| 4,077,442 | 3/1978 | Olofsson | 141/20 |
| 4,093,123 | 6/1978 | Maran | 141/20 |
| 4,108,219 | 8/1978 | Shulsinger | 141/20 |
| 4,154,271 | 5/1979 | Saeki | 141/20 |
| 4,174,811 | 11/1979 | Binder et al. | 141/20 |
| 4,285,372 | 8/1981 | Kieber | 141/3 |
| 4,321,953 | 3/1982 | Grothoff | 141/2 |

FOREIGN PATENT DOCUMENTS

| | | | |
|---|---|---|---|
| 2402582 | 5/1979 | France | 141/20 |

*Primary Examiner*—Ernest G. Cusick
*Attorney, Agent, or Firm*—Handal & Morofsky

[57] ABSTRACT

Apparatus for the discharge of fusible materials from a container under a pressure higher than the normal atmospheric pressure by compressed air of laboratory purity or compressed from fresh air, wherein a common tank (1) suitable for receiving the fusible material (8) and the compressed air, is connected to an assembly head (6) by a pipe nipple (9), where lock valve (2), a nozzle (3) and a spring-supported (4) actuating key (5) are arranged in the assembly head (6) for actuaing the discharge process when the key is pressed down. Also a process for the filling and/or refilling of tanks suitable for the discharge of fusible materials from enclosed space is provided wherein air is used for discharging the fusible material.

9 Claims, 6 Drawing Sheets

APPARATUS FOR FILLING AND REFILLING OF CONTAINERS WITH FLOWABLE MATERIAL AND PRESSURIZED PROPELLANT

This application is a continuation, of application Ser. No. 688,909, filed Jan. 4, 1985 now abandoned.

FIELD AND BACKGROUND OF THE INVENTION

This invention relates to an apparatus for the discharge of fusible materials from a container under pressure higher than the normal atmospheric pressure, by compressed air of laboratory purity or compressed from fresh air, furthermore process and apparatus for filling and refilling of such containers.

Appliances used for the discharge of fusible materials under superpressure have been in general use in various alternatives. Best known are the aerosol appliances, where the dispersion takes place from a sealed tank with the aid of freon gas. It is generally known that the gas—despite its favorable mechanical property—has become more and more unpopular for environment- and health-protective reasons, and consequently its use was prohibited in several countries.

The principle of operation is based on the fact, that the freon in the tank is mixed with the liquid to be dispersed and thus it ensures the required propulsive energy at approximately constant rate.

Aerosol is used in the the USA Pat. No. 3 240 331 without internal tube, but with internal tank, and the dispersion takes place upon blending of a two component synthetic resin following the discharge of the tank.

The propellant of the USA Pat. No. 2 559 091 is also aerosol, here the gas is passed through the material to be dispersed by a piercing needle upon screwing together the two tanks, and this composite will be dispersed. The appliance can be refilled, its handling is awkward.

In the USA Pat. No. 3 858 659—where a large cartridge tank with propellant is arranged—the appliance becomes operative with the aid of a piercing needle. The appliance can be refilled, its sealing is rather difficult.

The USA Pat. No. 3 984 034 does not use aerosol, but a tubular plastic tank is encased in the solid sealed tank, a piston from underneath pushes the tank under superpressure in the direction of the nozzle, and the material passes through a needle into the sprayer mechanism.

Operation of the USA Pat. No. 3 619 092 is similar, but here the piston is replaced by gas suitable for the generation of superpressure. The handling and refilling of both appliances are cumbersome.

Attempts are known which are aimed at producing the kinetic energy of the materials to be dispersed with LP or $CO_2$ gas, although they are extremely harmful to the health and their environment, their carcenogenic effect is nearly certain, and the LP gas is definitely incendiary.

At the same time these gases are not neutral gases, consequently they are applicable for the dispersion of hygienic or industrial agents only at the expense of quality deterioration, while they are definitely unsuitable for the dispersion of drugs.

Such solution is also known where the material to be dispersed is in a plastic /foil/ hose arranged in a tube, which is screwed into a body provided with nozzle and piercing needle, then this assembly is screwed into a further body in which a piston and a high-pressure air-cartridge are arranged. The air is let under the piston by a piercing needle that pushes the hose towards the other needle, whereby the dispersion becomes possible. However, in this case a considerable amount of material is retained, handling of the appliance is very complicated, it is liable to cause accident, and it has numerous parts. Its commercial refilling is nearly impossible.

Its advantage is that the propellant is not in contact with the material to be dispersed.

The essential feature of another construction is that the liquid to be dispersed passes from an enclosed space through a piercing needle into the nozzle by non-purified pressurized air with the aid of an intermediate mechanism (eg. rubber membrane), and the cartridge containing the pressurized air is arranged under the tank. It becomes operative upon screwing together the two parts. In another alternative the cartridge of the pressurized air is arranged in the tank of the medium within a cylindrical container, and it becomes operative with the aid of a piercing needle similarly upon screwing together the two parts. The fundamental fault of each system is that the construction is complicated. Advantage: they can be refilled, though with difficulty. At the same time the appliance has to be unscrewed on each occasion, and the used cartridges and tanks of the fusible medium (hoses, flasks) are discarded and replaced, and in case of Aeronon the propellant cartridge is filled under a pressure of minimum 70 bar, which requires strict safety technique. The discarded material represents waste and is an environment pollutant.

The charging machines of the sprayers filled with aerosol gas (freon, LP, $CO_2$, dinitrogen oxide) generally function in several steps, i.e. they discharge the liquid, stop mechanically, then charge the propellants in liquid state into the tank where the propellants are absorbed in the liquid. The machines are suitable only for a first filling and not for refilling. The gases retained in the discharged appliance can be checked only with instrument, consequently their refilling is definitely prohibitive.

OBJECTS AND SUMMARY OF THE INVENTION

Therefore, an object of the present invention is to provide a sprayer for the dispersion of fusible materials, which avoids the unfavourable characteristics of the mentioned appliances, while at the same time has a lower cost, provides improvements in health-environment protection and safety technique, and furthermore is suitable for the dispersion of fusible materials such as drugs, cosmetics, baby cosmetics and for food-products, e.g. edible oils.

Another object of the present invention is that the discharged sprayer should not be discarded, but refilled. This is ensured by air used as propellant and by the refilling system realized within the scope of the invention, which ensures the multiple and safe refilling of the discharged sprayers, and it is fundamentally different from the theoretical and practical construction of the presently used charging machines.

According to the present invention these objects are achieved by providing the appliance used for the discharge of fusible materials from enclosed space with a tank suitable for receiving the fusible material and the compressed air, which is attached to the assembly head with a pipe nipple, in which a lock valve and nozzle, as well as a spring-supported actuating key are arranged.

The joint between the tank and the assembly head may be threaded, flanged or welded.

During filling or refilling of the appliances first the fusible material is injected into the tank, followed by injection of the gas ensuring the discharge of the fusible material, where air is used as propellant to be injected until the specific pressure is attained.

The filling or refilling apparatus containing a tank for the fusible material, feed unit, charging stub and check valve arranged between the charging stub and the feed unit is constructed according to the invention in such a way that it is provided with an air supply tank connected through the check valve to the charging stub. Suitably a pressure reducer and/or pressure control device is built into the pipe between the air supply tank and the charging stub.

Several feed units may be connected through the check valve to the pipe between the air supply tank and the charging stub.

A primary feature of the invention is that the material to be dispersed is arranged within the tank of the fusible material together with the suitably compressed fresh air, or purified compressed air, which removes all mechanical air pollutants, as a result of which the oils, combustion products, powders, etc. will be filtered, and air free from all mechanical contaminants passes into the tank. The compressed air in the tank forces the fusible material through an elastic pipe—reaching to the lowest point of the fusible material—to the valve of the sprayer. Upon pressing the spring in the receiving head with the aid of the key, the valve opens the path of the fusible material and thus its outflow is free through the nozzle. The pressurized air first discharges the tank, then the elastic pipe and finally the valve and the nozzle as well, thus it completely removes the fusible material from the appliance, and during this process it represents no danger either for the healthy or sick person, while its operation is extremely simple. The appliance according to the invention may have several alternatives which all have their own advantages. The tank can be brought into operative locked condition with the sprayer device by screwing them together with the thread machined on the tank and on the assembly head. At the same time upon discharge or when the pressure is released, the appliance can be unscrewed, refilled with fusible material and compressed air, and thus the dispersion can be repeated theoretically over and over again.

According to another alternative, the tank is in fixed connection with the sprayer device by way of mechanical flanging.

The tank and the sprayer device may also be jointed by welding. The welding may be different according to the specific properties of the parts.

The two latter alternatives do not allow simple, e.g. manual access to the material in the tank.

One of the main advantages of the invention is that the air as propellant is suitable for the dispersion of the fusible material in such a form that it propels the liquid from the pressurized space, or the liquid mixed with air passes off through the nozzle.

Further advantage of the invention is that the the air used as propellant never reaches the value of the critical pressure, i.e. 30 bar, consequently it will not result in qualitative deterioration of the fusible material in the tank. The applied superpressure is a partial pressure in every case, the maximum-minimum value of which never reaches the critical 30 bar pressure, but it is always higher until discharge, than the normal atmospheric pressure. The superpressure can be fully released from the tank only after discharge of the fusible material.

Yet another advantage of the invention is that the tank can be refilled without undoing the mechanical safe sealing, since the refilling is independent from the residual pressure of the flask and therefore it remains safe. During refilling the spray valve if to be set into the same position as during dispersion, and thus through the open path a special hermetically connected charging head admits first the liquid of an accurately specified cubic capacity into the sprayer, then the same charging head feeds the air of the required purity into the tank under the pressure specified in advance, and while the pressurized air flows in, it cleans the charging head completely from the injected fusible material.

Since the charging head may be connected to one or several tanks, thus a single charging mechine with its self-cleaning system is suitable for the filling of the same or different types of fusible material, as well as for the refilling of the discharged sprayer.

BRIEF DESCRIPTION OF THE DRAWINGS

The invention will be more apparent from the following detailed description of preferred embodiments of the invention with reference to the enclosed drawings, in which.

DESCRIPTION OF THE PREFERRED EMBODIMENTS

Figure 1:
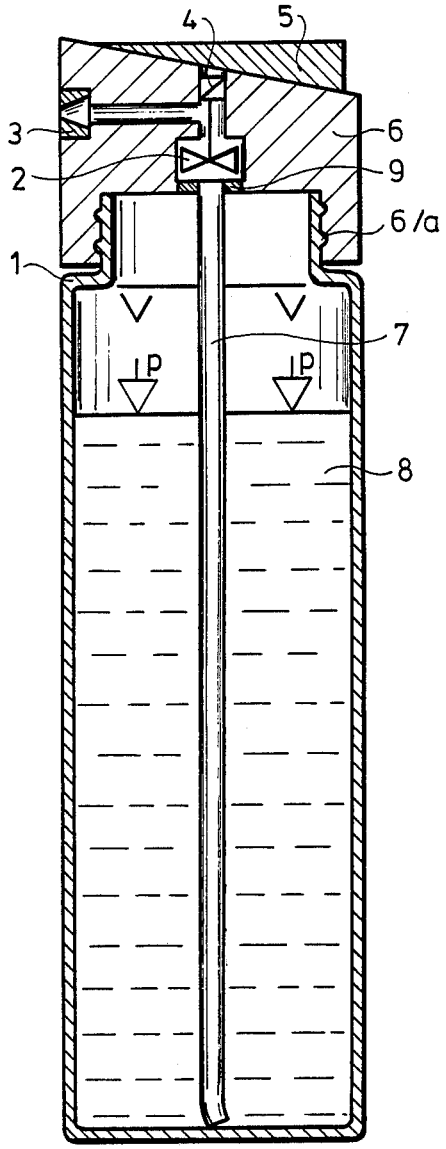
FIG. 1 is a longitudinal section of the integral tank and sprayer device with threaded connection.

Tank 1 shown in FIG. 1 is suitable for receiving the fusible material 8, which is influenced by the compressed air as propellant from space V under pressure p. The material passes through elastic pipe 7 with the aid of pipe nipple 9 through atomizer 2, which is actuated by spring 4 with key 5, and thus it is dispersed through nozzle 3. The assembly head 6 is jointed to tank 1 with thread **6/*a***, the tank is threaded, it can be unscrewed and fastened again.

Figure 2:
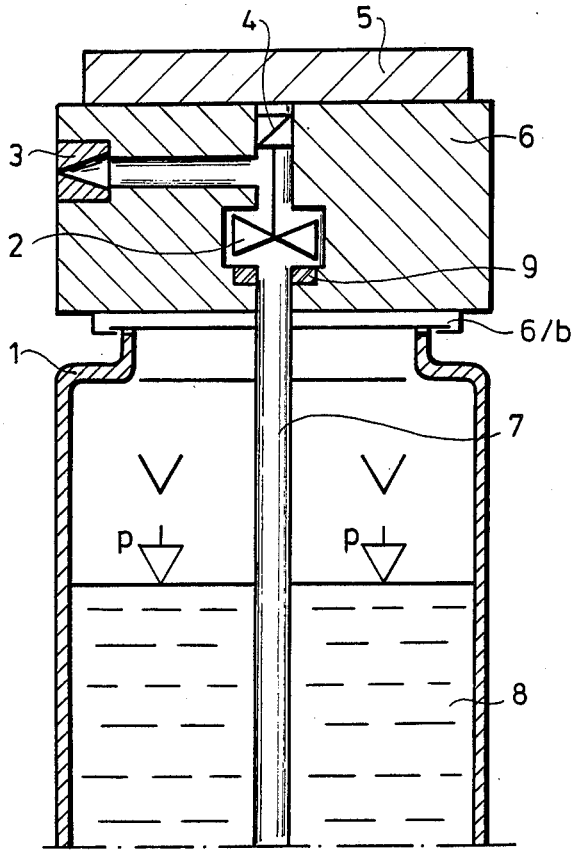
FIG. 2 is a section showing the characteristics of the flanged sealing.

In the alternative shown in FIG. 2, the assembly head 6 jointed to the tank 1 through mechanical flange **6/*b*** can be released only by mechanical power.

Figure 3:
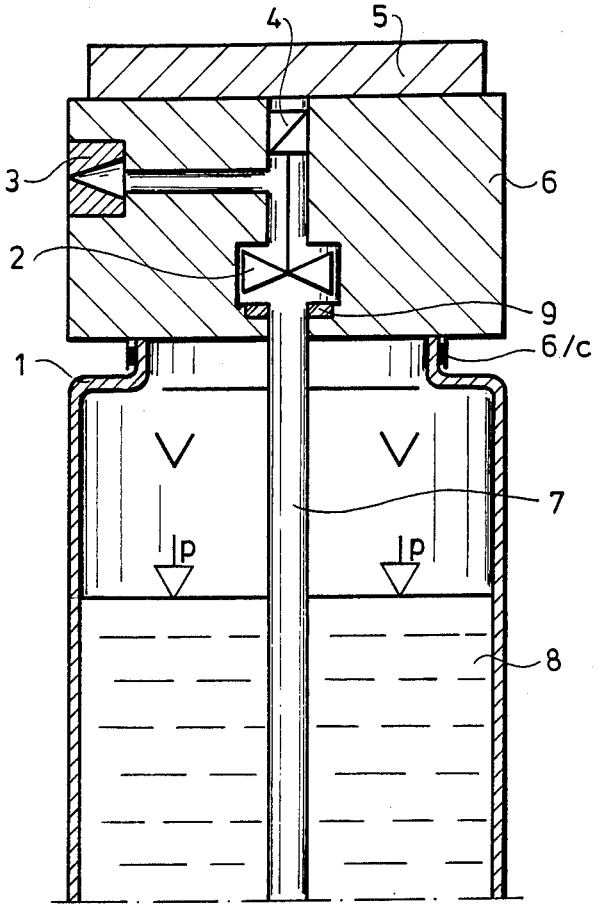
FIG. 3 is a section showing the characteristics of the welded sealing.

In the alternative shown in FIG. 3, the assembly head 6 is jointed by welding **6/*c* to the tank 1**, which can be disjointed only by destruction.

Figure 4:
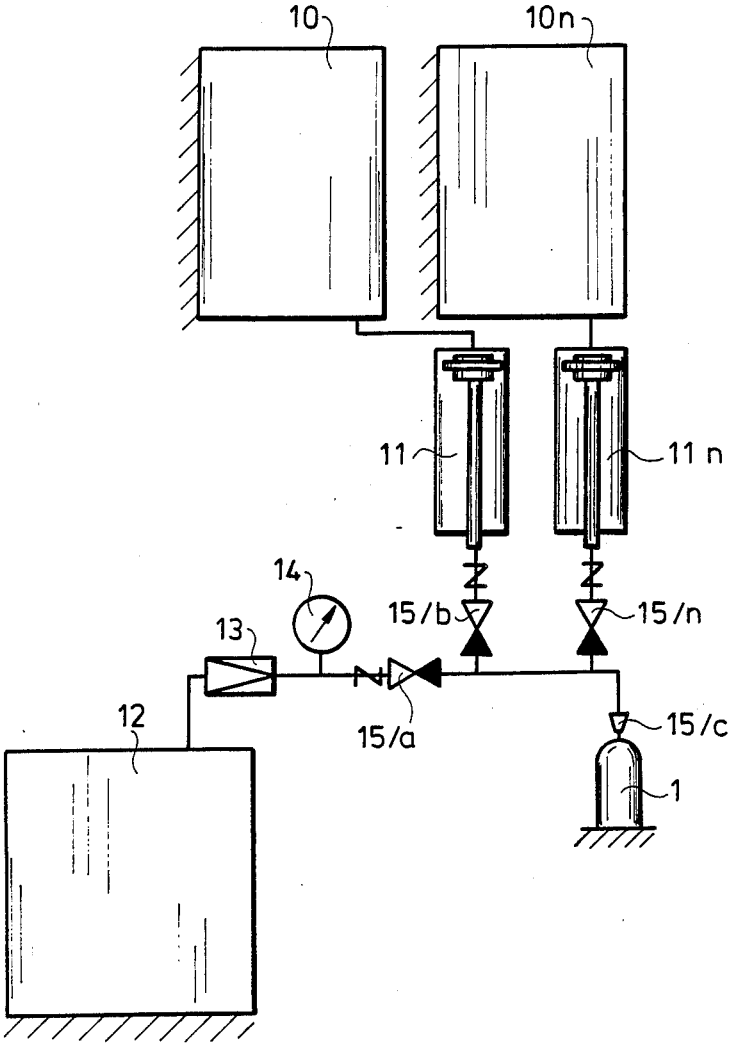
FIG. 4 is a principle of operation of the refilling machine.

FIG. 4 shows the new type of filling and/or refilling system, where the fusible material of specific cubic capacity can be injected from the supply tanks 10, **10*n* of the fusible material into the air-tight empty or discharged tank 1 with the aid of feed units 11, 11*n* through check valves 15/*b*, 15/*n* and through a pipeline and a special charging stub 15/*c*. Then the compressed air of specified purity controlled by pressure control valve 14 flows in from the air supply tank 12 with the insertion of pressure reducer 13 and pressure control valve 14** through check valve 15/*a* and pipeline until the differential pressure is equalized in the tank 1.

Figure 5:
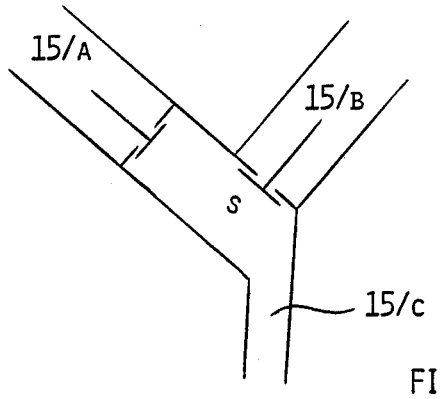
FIG. 5 is a special charging head.
Figure 7:
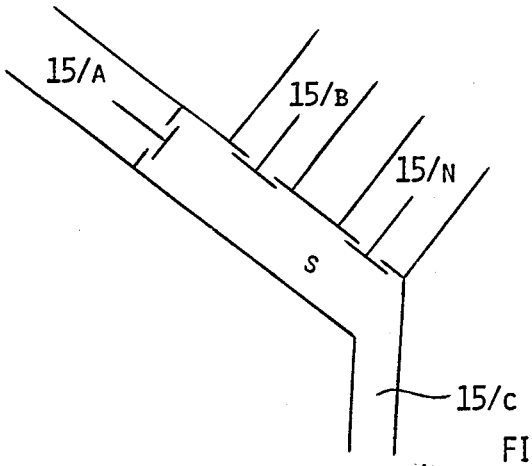
FIG. 7 is an alternative embodiment of a charging head.

A special charging tub is shown in FIGS. 5 and 7, which is suitable for the feeding of the same (FIG. 5) and/or different types of fusible material (FIG. 7) in such a way, that first the check valve 15/*b*, or 15/*n* opens, then after its closing the air flowing through the check valve propels the residual fusible material from the pipeline S through the charging stub 15/*c* into the tank 1, which is cleaned, and the next filling and/or refilling is carried out from the next, optional tank free from the previous fusible material. The number of the supply tanks 10 and 10*n*, feed units 11 and 11*n*, check valves 15/*b* and 15/*n* is optional, and thus theoretically infinite number of fusible material can be filled and/or refilled through one charging stub and one filling and/or refilling machine.

Figure 6:
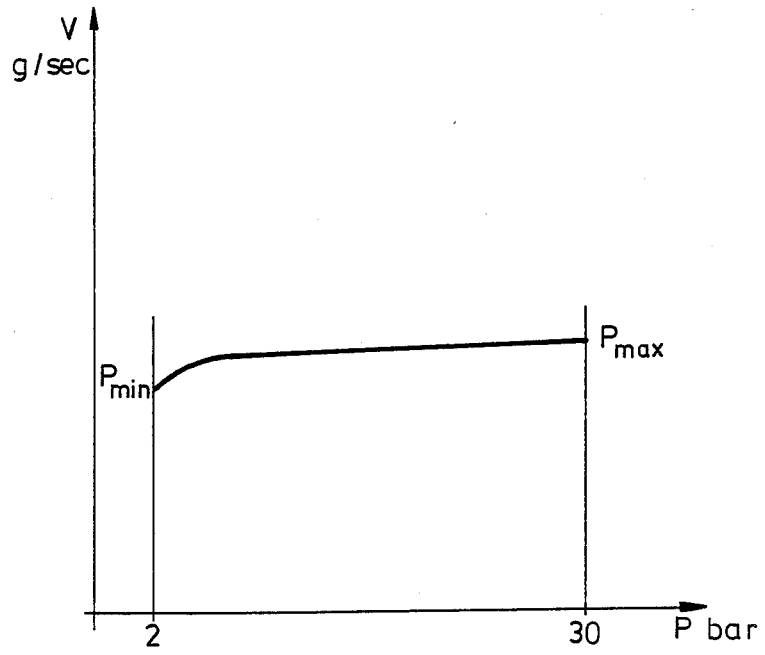
FIG. 6 is a pressure condition in the sprayer.

FIG. 6 shows the condition of the pressure prevailing in the tank. As seen it has a starting pressure $P_{max}$, which is always lower than 30 bar, and final pressure $P_{min}$ which is always minimum 2 bar. Meanwhile the flow velocity of the fusible material remains approximately constant.

Tests have shown that the appliances fitted with threaded assembly head as shown in FIG. 1, or with the flanged and welded joint are functionally correct, the material encased in the tank is removed completely and it is free from contamination, and they are suitable for refilling either with the same or different materials, particularly in case of the alternative shown in FIG. 1. The shape of the tank may be optional, thus: circular, oval, flat, or polygonal (quadrangle, hexagonal, octagonal, etc).

Furthermore, the experiments have shown that the process is suitable for the complete discharge of cosmetics, detergents, machine-oil, edible oils and certain drugs without qualitative change, and for the refilling of such discharged tanks as well.

What we claim is:

1. An apparatus for the filling and refilling of tanks suitable for the discharge of fusible materials comprising:

(a) a plurality of feed tanks containing different fusible materials;

(b) a feed unit means associated with each feed tank for feeding the output of its respective feed tank;

(c) a plurality of feed check valves for valving the output of a respective feed unit means;

(d) a propellant gas supply tank;

(e) a propellant gas check valve;

(f) a propellant gas conduit between said supply tank and said propellant gas check valve;

(g) a charging stub; and (h) a further propellant gas conduit between said propellant gas check valve and said charging stub, said further propellant gas conduit also communicating with each of said plurality of feed check valves and thus connecting said feed check valves to said charging stub whereby propellant gas passing through said further propellant gas conduit purges said further propellant gas conduit of any remaining fusible maerial admitted by said plurality of feed check valves.

2. An apparatus for the filling and refilling of tanks suitable for the discharge of fusible materials comprising:

(a) a feed tank containing fusible material;

(b) a feed unit means associated with said feed tank for feeding the output of said feed tank;

(c) a of feed check valve for valving the output of said feed unit means;

(d) a propellant gas supply tank;

(e) a propellant gas check valve;

(f) a propellant gas conduit between said supply tank and said propellant gas check valve;

(g) a charging stub; and (h) a further propellant gas conduit between said propellant gas check valve and said charging stub, said further propellant gas conduit also communicating with said feed check valve and thus connecting said feed check valve to said charging stub whereby propellant gas passing through said further propellant gas conduit purges said further propellant gas conduit of any remaining fusible material admitted by said feed check valve, wherein said further propellant gas conduit between said propellant gas check valve and said charging stub comprises also, at least in part, said feed check valve which is connected to said charging stub.

3. An apparatus as claimed in claim 2, further comprising at least one additional tank for fusible material and an associated additional feed unit, a connecting conduit between said at least one additional tank and additional feed unit and an additional check valve in a conduit connecting said additional feed unit to said connection between said further check valve and said charging stub.

4. An apparatus as claimed in claim 2, wherein said supply tank of propellant gas is a supply tank of compressed normal atmospheric air.

5. An apparatus as claimed in claim 4, wherein said air enters said charging stub at below critical pressure.

6. Apparatus as claim in 1, further comprising a pressure reducer in said propellant gas conduit.

7. Apparatus as claim in claim 6, further comprising a pressure control valve in said propellant gas conduit between said pressure reducer and said propellant gas check valve.

8. Apparatus as claimed in claim 1, wherein said propellant gas enters said charging stub at less than critical pressure.

9. Apparatus as claimed in claim 8, wherein said supply tank of compressed propellant gas is a supply tank of compressed normal atmospheric air.

* * * * *